US005702874A

United States Patent [19]

Fyson et al.

[11] Patent Number: 5,702,874

[45] Date of Patent: Dec. 30, 1997

[54] METHOD OF PROCESSING PHOTOGRAPHIC SILVER HALIDE MATERIALS

[75] Inventors: John Richard Fyson, Hackney; Gareth Bryn Evans, Potten End, both of United Kingdom

[73] Assignee: Eastman Kodak Company, Rochester, N.Y.

[21] Appl. No.: 722,923

[22] Filed: Sep. 27, 1996

[30] Foreign Application Priority Data

Sep. 29, 1995 [GB] United Kingdom ..... 9519850

[51] Int. Cl.[6] ..... G03C 7/42

[52] U.S. Cl. ..... 430/373; 430/414; 430/943

[58] Field of Search ..... 430/373, 414, 430/943

[56] References Cited

U.S. PATENT DOCUMENTS 4,529,687 7/1985 Hirai et al. ..... 430/373

FOREIGN PATENT DOCUMENTS 0 620 488 A2 4/1993 European Pat. Off. .
9117479 11/1991 WIPO .

*Primary Examiner*—Hoa Van Le
*Attorney, Agent, or Firm*—J. Lanny Tucker

[57] ABSTRACT

High silver chloride photographic materials are processed using a development stop bath containing a sulfite fixing agent, followed by bleaching, fixing and treatment with an oxidizing agent that destroys sulfite ions. No washing or stabilizing steps are used after the treatment with oxidizing agent.

11 Claims, 4 Drawing Sheets

METHOD OF PROCESSING PHOTOGRAPHIC SILVER HALIDE MATERIALS

FIELD OF THE INVENTION

This invention relates to the processing of color materials comprising an emulsion having at least 85 mol % silver chloride. The materials are intended for both conventional processing containing relatively high silver coverage levels and redox amplification (RX) processes containing relatively low silver coverage levels.

BACKGROUND OF THE INVENTION

In the field of low silver coverage photographic materials intended for RX processes it has been proposed to use a fixer comprising an alkali metal sulfite as fixing agent and a bleach comprising a peroxide and an alkali metal halide. These proposals are described in European Publications 0 540 619, 0 506 909, and 0 470 083.

Such fixers and bleaches are more environmentally friendly than thiosulfate fixers or bleaches containing ferricyanide ions or complexes of iron as the bleaching agent.

The silver level, however, in conventionally processed materials is much higher than those used with RX processes, hence process times are expected to be longer when they are applied to conventional materials. For example, if there is more silver halide to remove, more time will be taken for the fixing step. It has however been found that silver halide materials comprising an emulsion having at least 85% silver chloride can be processed using a sulfite fixer.

Such a process needs a wash or stabilize step after a sulfite fix to remove unused sulfite that would otherwise cause increased Dmin in the processed material. When such a process is carried out in a processing machine it is customary to split the wash step into up to 4 consecutive wash steps in order to use the minimum amount of water because the washing has increased efficiency in this configuration.

There are references in the literature to 'hypo eliminators' (Review in Photographic Journal p 458, 1940) used for removing traces of fixer, the best being alkaline ammoniacal hydrogen peroxide.

The problem is therefore to provide a process using a sulfite fixer that minimizes the number of processing steps needed so that existing processing machines can still be employed.

SUMMARY OF THE INVENTION

According to the present invention there is provided a method of processing an imagewise exposed photographic silver halide material comprising at least two dye image-forming layer units responsive to different regions of the spectrum in which the silver halide in each layer comprises at least 85 mol % silver chloride, and the layer units contain a dye image- forming color coupler, the method comprising, in sequence, the step of dye image formation, followed by the steps of:

(a) treating the material in a bath which stops dye image formation and optionally contains a fixing agent which will not prevent bleaching in a subsequent bleach bath, (b) bleaching the material in a first bleach bath containing hydrogen peroxide as bleaching agent, or a material that provides hydrogen peroxide, and an alkali metal halide, (c) fixing the material in a fixing bath that contains an alkali metal sulfite or a material that provides sulfite as fixing agent, and (d) treating the material in a bath containing a colorless oxidizing agent that destroys sulfite ions which bath has a pH of 5 or below, and wherein no washing or stabilizing steps are carried out after step (d).

Preferably the bath in (a) contains an alkali metal sulfite or a material that provides sulfite as the fixing agent. If it is purely a stop bath it may comprise 5% acetic acid.

Excellent sensitometric and keeping properties can be obtained without the use of any wash baths.

The use of bleach fix baths containing a bleaching agent of the ferric EDTA type is avoided.

The use of a sulfite fix immediately after a color development step eliminates the bad effects caused when this bleach or bleach-fix solution splashes back into the developer bath. This can cause fogging. Our invention is ammonia free and fails to work in alkaline solution and is not applied to a process in which hypo (thiosulfate) is used.

Silver is precipitated in the fix making silver recovery easier than usual.

DETAILED DESCRIPTION OF THE DRAWINGS

Figure 1:
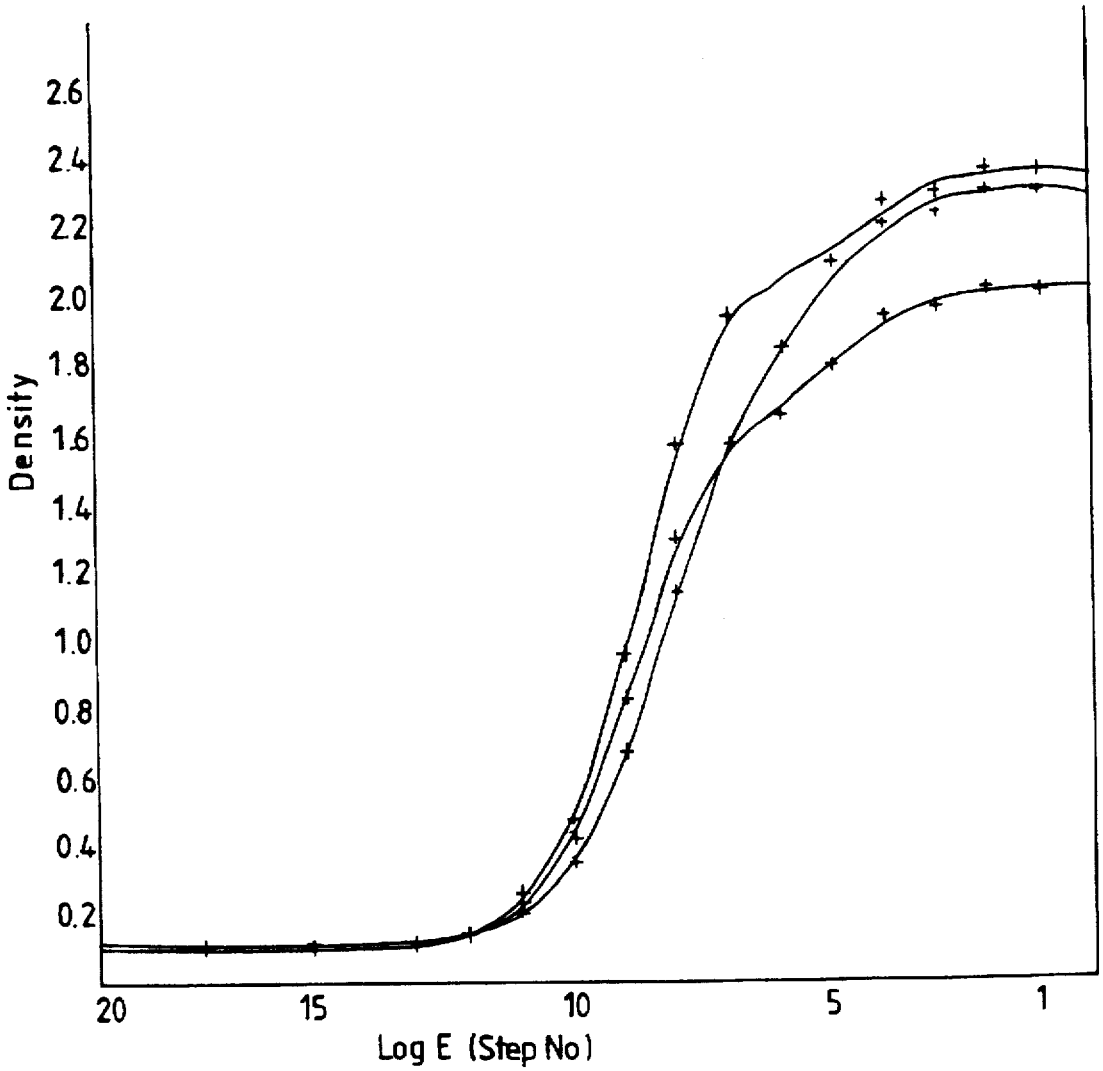
FIGS. 1–4 of the accompanying drawings illustrate the results of Examples 3 and 4 below.

The oxidizing agent of the final bath (step d) may be a peroxide, persulfate or periodate. Hydrogen peroxide or a material that provides hydrogen peroxide is preferred. The bath may also contain an alkali metal halide. Its pH may be in the range 3 to 5, and preferably from 4 to 5. The bath may contain from 10 to 200 g/l, preferably from 30 to 100 g/l, of 30% w/w hydrogen peroxide solution. The bleach bath may also contain from 0.5 to 30 g/l of alkali metal halide (as sodium chloride). Preferably peroxide is the sole oxidizing agent.

The dye image-forming step may be a conventional color development step and/or a redox amplification step. Such developer/amplifier solutions contain a peroxide oxidant in addition to the color developing agent. Such solutions may contain preservative materials that will minimize the reaction between the developing agent and the oxidant. Many compounds have been proposed, for example, hydrazines, hydroxylamines, hydroxamic acids, oximes, nitroxy radicals, hydrazines, hydrazides, phenols, saccharides, monoamines, diamines, tertiary amines, polyamines, quaternary ammonium salts, alpha-hydroxy ketones, alcohols, diamides and disulfonamides. The preferred antioxidants are hydroxylamine compounds, especially hydroxylamine itself. Many antioxidants are described in European Publication 0 410 375. The color developer solution may also contain other compounds that increase its stability, for example a long chain compound which can adsorb to silver, such as, dodecylamine.

A particular use for this technology is in the processing of silver chloride color photographic paper, for example a color paper comprising an emulsion having at least 85 mole percent silver chloride, and especially such papers with silver levels of from 20 to 2000 mg/m$^2$ (preferably in the range from 50 to 700 mg/m2).

Materials suitable for redox amplification processing will contain low amounts of silver. The total silver coating weight may be in the range from 10 to 150 mg/m$^2$, preferably from 30 to 100 mg/m$^2$ and particularly from 40 to 90 mg/m$^2$.

The baths of steps (a) and (c) may contain from 20 to 150 g/l of the alkali metal sulfite (as sodium sulfite) as fixing agent. Corresponding levels of materials that provide sulfite during processing, e.g., an alkali metal metabisulfite can also be used. The baths may have a pH above 6.4, preferably in the range 6.5 to 9, especially 7.0. A buffering material may be used, for example an alkali metal acetate in order to maintain the desired pH. Preferably, sulfite ions are the sole fixing agent.

The bleaching agent is hydrogen peroxide or a material that provides hydrogen peroxide, e.g., a persulfate. The bleach bath may contain from 10 to 200 g/l, preferably from 30 to 100 g/l of 30% w/w hydrogen peroxide solution. The bleach bath may also contain from 0.5 to 30 g/l of alkali metal halide (as sodium chloride). Preferably peroxide is the sole bleaching agent.

The bleach may also contain metal-chelating agents to avoid them catalyzing the hydrogen peroxide. Such compounds may be 1-hydroxyethylidene-1,1'-diphosphonic acid or diethyltriaminepentaacetic acid type.

The first bleach preferably has a pH in the range 8 to 11 and is preferably about 10. It may contain a buffer, for example an alkali metal carbonate. The second bleach bath, however, must have a pH of 5 or below or it does not function correctly. At such a pH any residual sulfite ion is quickly oxidized by the peroxide bleaching agent.

The bath of step (d) may contain a bleaching agent as described for step (b) in the same amounts, and a pH of 5 or below.

Most commercial photographic processes are replenished systems in which additional chemicals (replenishers) are added to the processing solutions as they are used. For environmental reasons minimum replenishment is desirable as it produces minimum overflow and production of waste solutions. A problem is therefore to have the lowest possible replenishment rates without incurring oxidized developing agent stain in the processed material. The problem does not occur if the bleaching agent is not sufficiently strong to oxidize the color developing agent.

In the present case, low replenishment rate will tend to increase the amount of color developing agent entering the bleach bath. This can be oxidized by the peroxide thus causing stain. In order to minimize this effect a developing agent-absorbing material may be located in a bath after the color development but before the bleach or in the replenishing/recirculation line of said bath.

With a fresh process or one in which all baths are replenished at rates >250 ml/m$^2$ the Dmins of all layers are low. However with a process with reduced replenishment rates, e.g., below 250 ml/m$^2$, and particularly below 100 ml/m$^2$ for each bath, developing agent builds up in the bath of step (a) and is eventually carried into the bleach where it reacts non-imagewise to give stain.

In one embodiment a developing agent-absorbing material is located in a bath after the color development or in the replenishing/recirculation line of said bath. Preferably the developing agent-absorbing material is located in the first fix bath or in its replenishing/recirculation line.

The developing agent adsorbing material may be one or more of a number of the materials: activated carbon, ion-exchange resins, e.g., cationic, anionic and mixed bed or neutral polymeric resin beads. Carbon is preferred as it is cheap and has a good capacity but using a resin might allow the developer to be recovered and reused. Anionic resins are also particularly useful.

Examples of useful adsorbents are:

Norit RO 0.8 (activated carbon pellets), Darco 20–40mesh (activated carbon pellets), Darco <100 mesh (activated carbon pellets), Amberlite IRA-420(C1) (anionic resin), Amberlite IRC-50(H) (cationic resin), Amberlite XAD-4 (neutral polymer resin), Amberlite XAD-2 (neutral polymer resin), Duolite MB 6113 (mixed bed resin), and Amberlite IRA 458 (anionic resin).

The baths of steps (a) and (c) may be replenished separately or together. In one embodiment either (i) the replenisher for the fixing bath of step (c) comprises the overflow from the fixer of another processing line, or (ii) the overflow from the the fixing bath of step (c) is used to replenish the fixer from another processing line.

The other line may be a color negative film processing line.

The baths of steps (a) and (c) may be replenished using the same replenisher solution or the overflow from one bath comprises at least part of the replenisher for the other.

The photographic elements can be single color elements or multicolor elements having a paper or film base. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Suitable materials for use in this invention, can have any of the components described in Research Disclosure Item 36544, September 1994, published by Kenneth Mason Publications, Emsworth, Hants P010 7DQ, United Kingdom.

The processing solutions described herein are preferably used in a method of processing carried out by passing the material to be processed through a tank containing the processing solution that is recirculated through the tank at a rate of from 0.1 to 10 tank volumes per minute.

The preferred recirculation rate is from 0.5 to 8, especially from 1 to 5, and particularly from 2 to 4, tank volumes per minute.

The recirculation, with or without replenishment, is carried out continuously or intermittently. In one method of working both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence in a preferred embodiment of the present invention the ratio of tank volume to maximum area of material accommodatable therein (i.e., maximum path length x width of material) is less than 11 dm$^{3/}$m$^2$, preferably less than 3 dm$^{3/}$m$^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leq F/A \leq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank systems are described in more detail in the following references: U.S. Pat. No. 5,294,956, U. S. Pat. No. 5,179,404, U.S. Pat. No. 5,270,762, EP-A-559,025, EP-A-559,026, EP-A-55 92/17819, WO 93/04404, WO 92/17370, WO 91/19226, WO 91/12567, WO 92/07302, WO 93/00612, WO 92/07301, WO 92/09932 and US-A-5, 436,118.

The following Examples are included for a better understanding of the invention.

EXAMPLE 1

The photographic material used in this example was a color photographic paper, containing a pyrazolone magenta coupler, with a total silver laydown of 65 mg/m$^2$. It was exposed through a 0.15 log wedge with correction filters added to try to get a neutral gray scale.

The following solutions were made up:

Developer amplifier

| | |
|---|---|
| 1-hydroxyethylidene-1, 1'-diphosphonic acid | 0.6 g |
| Diethylenetriaminepentaacetic acid | 2.0 g |
| Dipotassium hydrogen phosphate.3$H_2O$ | 40.0 g |
| Hydroxylamine sulfate | 0.5 g |
| CD3 color developing agent | 4.5 g |
| Water to | 1 liter |

pH adjusted to 11.7 with sodium hydroxide 20 ml 3% w/w hydrogen peroxide was added just before use.

Fixer

| | |
|---|---|
| Sodium sulfite (anhydrous) | 50.0 g |
| Water to | 1 liter |

pH adjusted to 7.0 with sulfuric acid

Bleach

| | |
|---|---|
| 1-hydroxyethylidene-1, 1'-diphosphonic acid | 0.6 g |
| Diethylenetriaminepentaacetic acid | 2.0 g |
| Sodium chloride | 1.0 g |
| Sodium hydrogen carbonate | 20.0 g |
| Hydrogen peroxide (30% w/w) | 50.0 g |
| Water to | 1 liter |

pH adjusted to 10.0 with sodium hydroxide or sulfuric acid

Final bath

| | |
|---|---|
| 1-hydroxyethylidene-1, 1'-diphosphonic acid | 0.6 g |
| Diethylenetriaminepentaacetic acid | 2.0 g |
| Sodium chloride | 1.0 g |
| Sodium hydrogen carbonate | 20.0 g |
| Hydrogen peroxide (30% w/w) | 50.0 g |
| Water to | 1 liter |

Seasoned Stabilizer

EKTACOLOR Prime stabilizer made up

| | |
|---|---|
| as instructed | 600 ml |
| Fixer as above | 400 ml |

No pH adjustment

Process (carried out in upright processing tanks at 32 ° C. with good manual agitation)

| | |
|---|---|
| Developer amplifier | 45 seconds |
| Sulfite fixer | 45 seconds |
| Bleach 1 | 45 seconds |
| Sulfite fixer | 45 seconds |
| Final bath or seasoned stabilizer | 45 seconds |

Dry

Table 1 below shows the stains (Dmin) of the three color records for the different pH levels in the final bath after keeping in an oven at 50 ° C. at 50% humidity for 1 week.

TABLE 1

| Final Bath | Red Dmin | Green Dmin | Blue Dmin | Comment |
|---|---|---|---|---|
| 2 minute running water wash | 0.115 | 0.120 | 0.095 | Comparison |
| Seasoned stabilizer | 0.126 | 0.180 | 0.241 | Comparison |
| Final bath pH 9.0 | 0.139 | 0.179 | 0.243 | Comparison |
| Final bath pH 8.0 | 0.138 | 0.185 | 0.250 | Comparison |
| Final bath pH 7.0 | 0.123 | 0.159 | 0.241 | Comparison |
| Final bath pH 6.0 | 0.184 | 0.215 | 0.274 | Comparison |
| Final bath pH 5.0 | 0.114 | 0.127 | 0.107 | Invention |
| Final bath pH 4.0 | 0.115 | 0.125 | 0.105 | Invention |

Table 2 shows the maximum densities of the three color records for the different final bath pH levels after keeping in an oven at 50 ° C. at 50% humidity for 1 week.

TABLE 2

| Final Bath | Red Dmin | Green Dmin | Blue Dmin | Comment |
|---|---|---|---|---|
| 2 minute running water wash | 2.799 | 2.651 | 2.388 | Comparison |
| Seasoned stabilizer | 2.430 | 2.578 | 2.361 | Comparison |
| Final bath pH 9.0 | 2.706 | 2.609 | 2.360 | Comparison |
| Final bath pH 8.0 | 2.645 | 2.620 | 2.407 | Comparison |
| Final bath pH 7.0 | 2.782 | 2.672 | 2.297 | Comparison |
| Final bath pH 6.0 | 2.701 | 2.585 | 2.351 | Comparison |
| Final bath pH 5.0 | 2.775 | 2.665 | 2.409 | Invention |
| Final bath pH 4.0 | 2.750 | 2.658 | 2.344 | Invention |

The results show that this final treatment has no significant effect on Dmax and as long as the final bath has a pH<7.0, the stain level is no different from a washed sample. The poorly washed sample in a seasoned stabilizer showed a loss of Dmax presumably through some dye reduction by retained sulfite.

EXAMPLE 2

Example 1 was repeated but with artificially seasoned solutions and with only one final bath with the pH adjusted to 5.0. This seasoning was done by making up the solutions, making up separate fixers for the two fixing stages of the process. Each tank was seasoned as though the paper carried in 30 ml/m$^2$ and the replenishment rate for all the tailend solutions was 50 ml/m$^2$, i.e., 30 parts of the previous tank in the process were mixed with 50 parts of the tank replenisher solution (the solution formulae given above were used as replenisher).

The process was carried out as before and then repeated after stirring 800 ml of the seasoned first sulfite fixer with activated charcoal for 10 minutes and then filtering. Table 3 shows that the process without charcoal showed considerable staining. The process containing the charcoal treated fixer showed no staining and had similar stain levels as the strips processed with the low pH final bath in Example 1.

TABLE 3

| Fixer treatment | Red Dmin | Green Dmin | Blue Dmin | Comment |
|---|---|---|---|---|
| None | 0.171 | 0.156 | 0.135 | Comparison |
| Activated charcoal | 0.114 | 0.127 | 0.107 | Invention |

Strips processed in the system with the treated fixer showed similar oven keeping characteristics as the pH5 final bath experiment in Example 1.

EXAMPLE 3

The photographic material used in this example was a conventional color paper, KODAK 'Supra', containing a pyrazolone magenta coupler, with a total silver laydown of about 650 mg/m$^2$. The silver halide is essentially all silver chloride. This material was exposed in a sensitometer at 1/10 sec. through a 0.15 log wedge with correction filters added to try to get a neutral gray scale. The wedge also includes red, green and blue separations.

The following solutions were made up to be used in the processes that follow:

Developer

| | |
|---|---|
| 1-hydroxyethylidene-1, 1'-diphosphonic acid | 0.6 g |
| Diethylenetriaminepentaacetic acid | 2.0 g |
| Triethanolamine | 5.5 mls |
| Diethylhydroxylamine | 5 mls |
| Phorwite™ REU | 1 g |
| Potassium chloride | 6.4 g |
| Potassium carbonate | 25 g |
| 4-N-ethyl-N-(β-methanesulfonamidoethyl)-o-toluidine sesquisulfate | 4.5 g |
| Water to | 1 liter |

pH adjusted to 10.3 with sodium hydroxide

Sulfite Fixer

| | |
|---|---|
| Sodium sulfite (anhydrous) | 100.0 g |
| Sodium acetate | 40.0 g |
| Water to | 1 liter |

pH adjusted to 7.0 with sulfuric acid

Bleach 2

| | |
|---|---|
| 1-hydroxyethylidene-1, 1'-diphosphonic acid | 1.0 g |
| Sodium chloride | 20.0 g |
| Sodium hydrogen carbonate | 3.0 g |
| Sodium carbonate | 4.0 g |
| Hydrogen peroxide (30%) | 50.0 g |
| Water to | 1 liter |

pH adjusted to 10.0 with sodium hydroxide or sulfuric acid

Process

| | |
|---|---|
| Developer | 45 seconds |
| Sulfite fixer | 90 seconds |
| Bleach 2 | 90 seconds |
| Sulfite fixer | 90 seconds |
| Final bath (pH 5.0) | 60 seconds |

Dry

Figure 2:
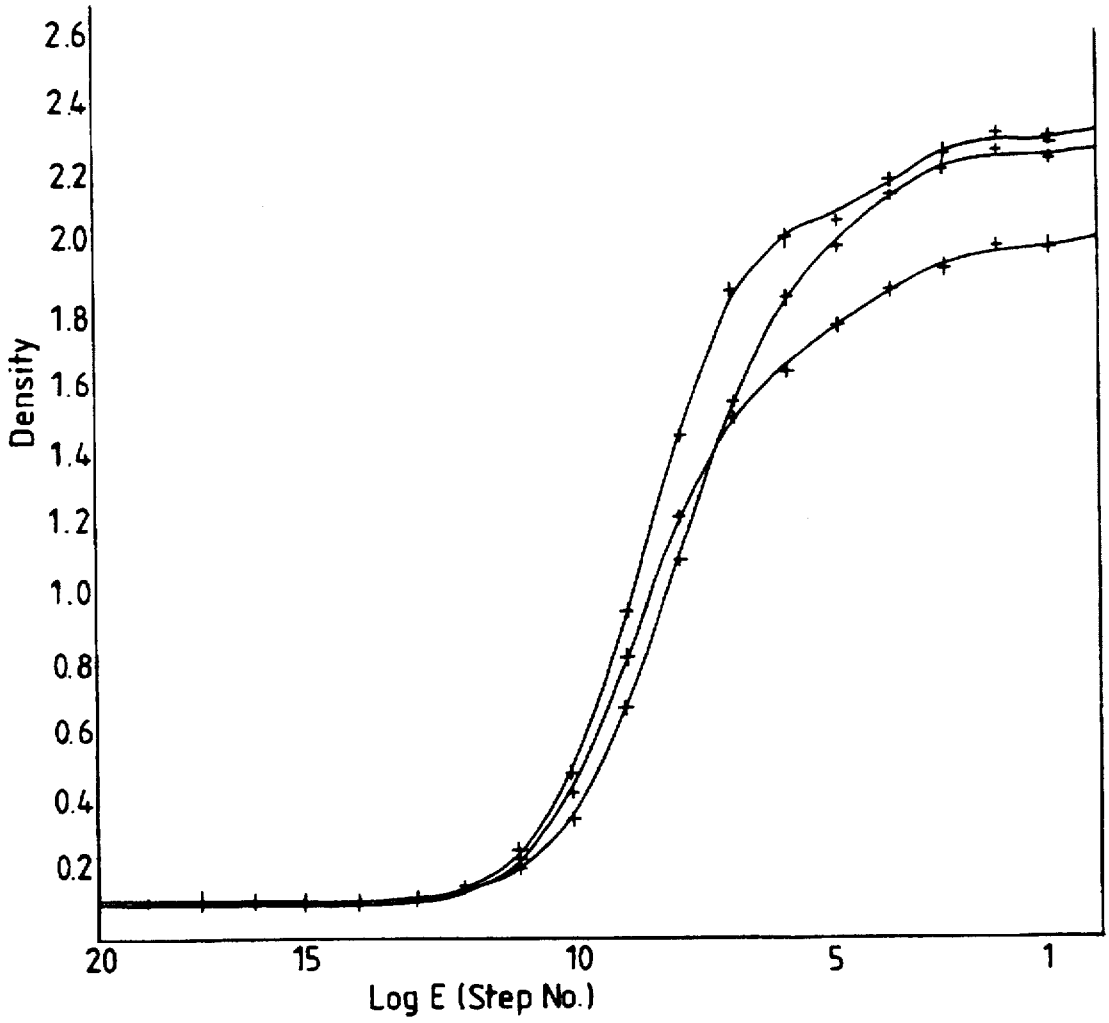

FIGS. 1 and 2 show the sensitometry comparison between the paper processed with a standard EKTACOLOR RA tailend of bleach-fix then stabilized in 4 tanks (FIG. 1) and the process outlined immediately above (FIG 2). There is no significant difference indicating that the invention can be used in place of the bleach-fix process. This process invention removes the need for ammonia, iron and EDTA in the effluent.

EXAMPLE 4

Figure 3:
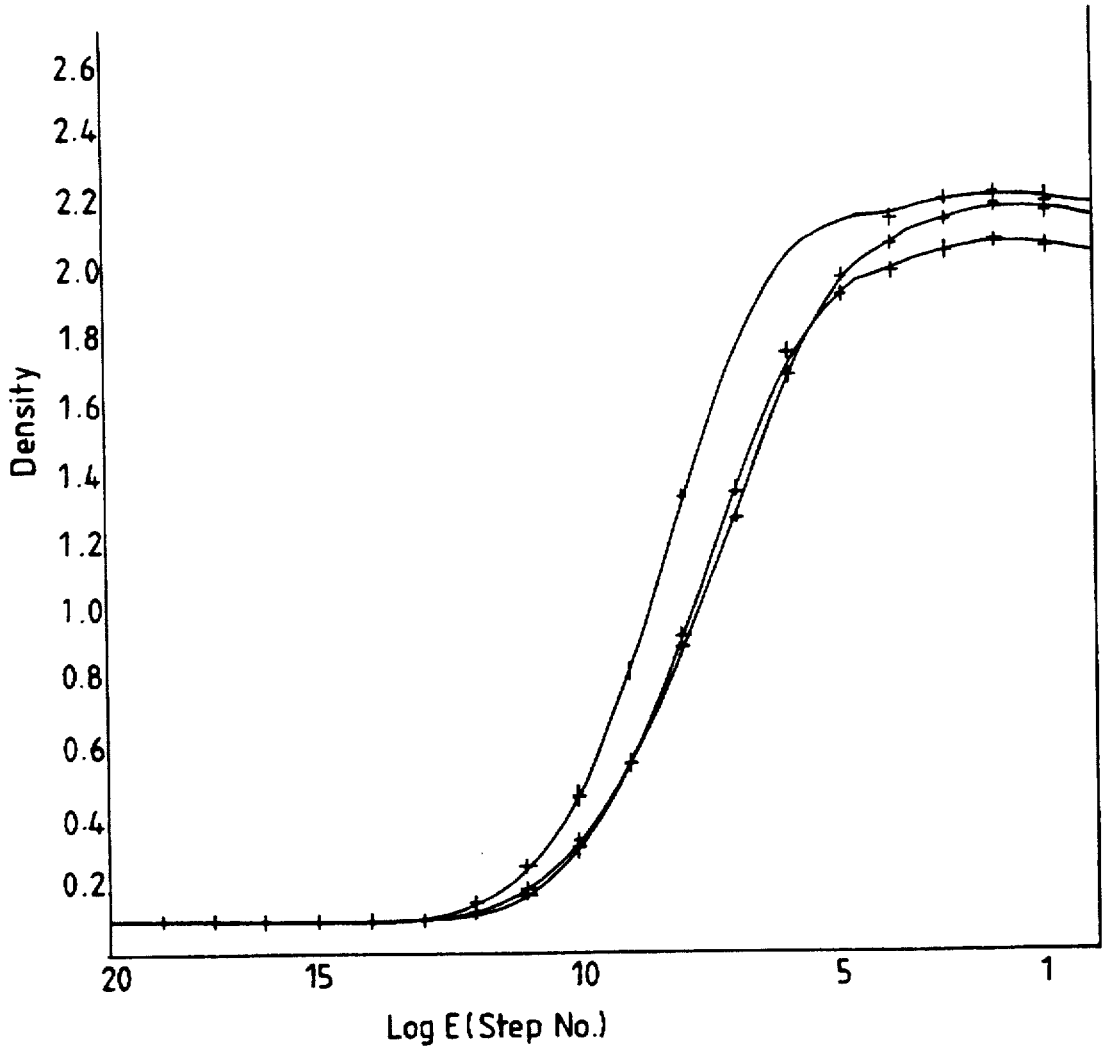
Figure 4:
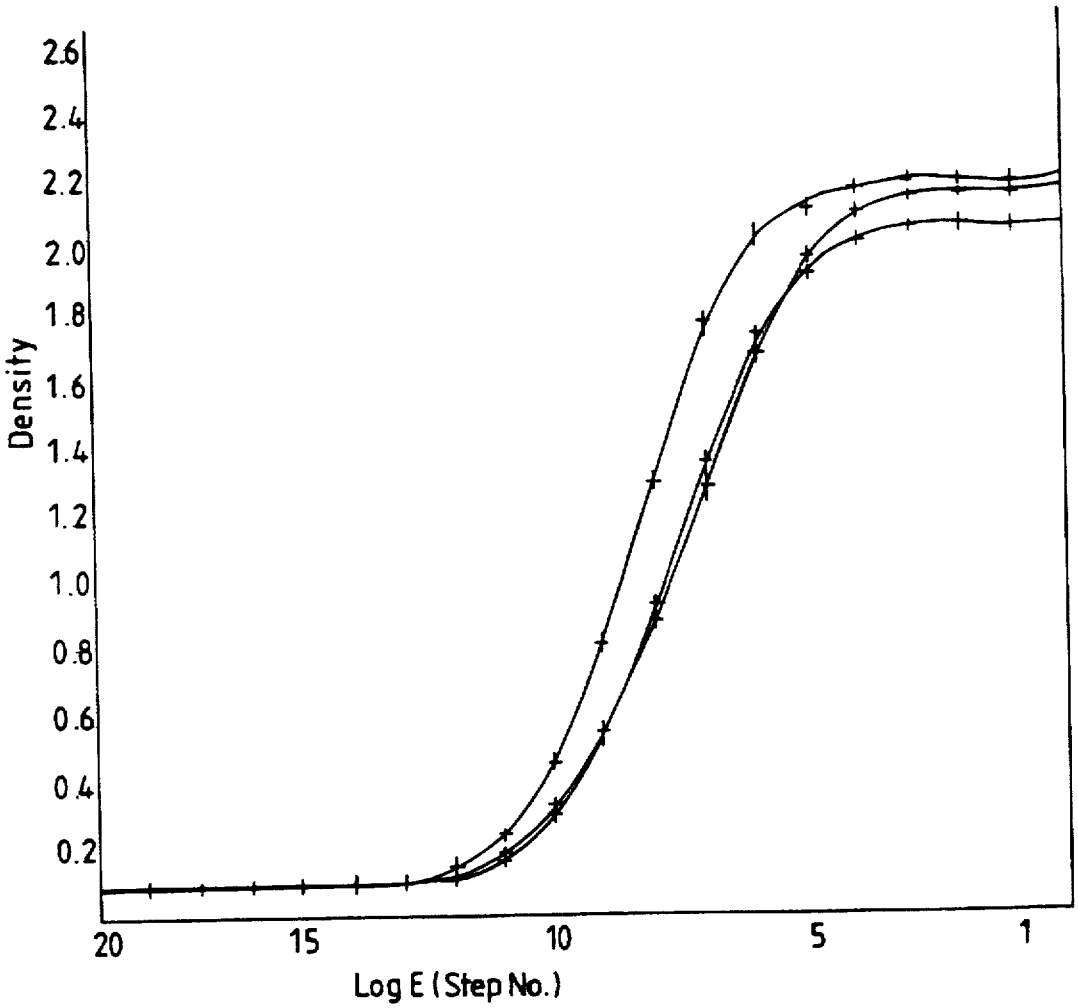

Example 3 was repeated using a paper with conventional silver laydown containing a pyrazolotriazole coupler (Fuji SFA-3). The sensitometries are shown in FIG. 3 (prior art) and 4 (invention). Again the differences are not significant showing that this process is applicable to systems containing pyrazolotriazole couplers.

The invention has been described in detail with particular reference to preferred embodiments thereof, but it will be understood that variations and modifications can be effected within the spirit and scope of the invention.

We claim:

1. A method of processing an imagewise exposed photographic silver halide material comprising at least two dye image-forming layer units responsive to different regions of the spectrum in which the silver halide in each layer comprises at least 85 mol % silver chloride, and the layer units contain a dye image-forming color coupler, said method comprising, in sequence, the step of dye image formation, followed by the steps:

(a) treating said material in a bath which stops dye image formation (b) bleaching said material in a first bleach bath containing hydrogen peroxide as bleaching agent, or a material that provides hydrogen peroxide, and an alkali metal halide, (c) fixing said material in a fixing bath that contains an alkali metal sulfite or a material that provides sulfite as fixing agent, and (d) treating said material in a bath containing a colorless oxidizing agent that destroys sulfite ions which bath has a pH of 5 or below, and wherein no washing or stabilizing steps are carried out after step (d).

2. The method of claim 1 wherein the bath in step (a) contains a fixing agent that will not prevent bleaching in a subsequent bleach bath.

3. The method of claim 1 wherein said oxidizing agent is hydrogen peroxide or a material that provides hydrogen peroxide.

4. The method of claim 1 wherein said dye image-forming step is a color development and/or redox amplification step.

5. The method of claim 1 wherein at least one of the processing baths is replenished.

6. The method of claim 5 in which either (i) the replenisher for the fixing bath of step (c) comprises the overflow from the fixer of another processing line, or (ii) the overflow from the fixing bath of step (c) is used to replenish the fixer from another processing line.

7. The method of claim 6 wherein the other processing line is used for processing a color negative film.

8. The method of claim 5 wherein the two baths of steps (a) and (c) are replenished using the same replenisher solution, or the overflow from one bath comprises at least part of the replenisher for the other.

9. The method of claim 1 carried out by passing said material through a tank containing a processing solution that is recirculated through the tank at a rate of from 0.1 to 10 tank volumes per minute.

10. The method of claim 1 carried out in a machine wherein the ratio of tank volume to maximum area of material accommodatable therein is less than 11 $dm3/m^2$.

11. The method of claim 2 wherein said fixing agent is an alkali metal sulfite or a material that provides sulfite as a fixing agent.

* * * * *